United States Patent [19]

Schertler

[11] 4,012,276

[45] Mar. 15, 1977

[54] APPARATUS FOR THE MANUFACTURE BY MACHINE OF MULTILAYER CORRUGATED PAPER MATERIAL

[75] Inventor: Manfred K. Schertler, Neuburg, Danube, Germany

[73] Assignee: Kartonagen-Schertler, Manfred K. Schertler & Co., Neuburg, Danube, Germany

[22] Filed: May 28, 1975

[21] Appl. No.: 581,639

[30] Foreign Application Priority Data

Nov. 11, 1974 Germany ..... 2453297

[52] U.S. Cl. ..... 156/558; 156/555; 156/563

[51] Int. Cl.[2] ..... B31F 5/00

[58] Field of Search ..... 156/205, 210, 470–473, 156/200, 299, 443, 539, 548, 555–559, 563, 566, 580, 582, 583; 198/55; 156/211

[56] References Cited

UNITED STATES PATENTS

| | | | |
|---|---|---|---|
| 2,817,306 | 12/1957 | Oakes | 156/556 X |
| 3,031,906 | 5/1962 | Holman | 198/35 X |
| 3,330,717 | 7/1967 | Roullard | 156/548 |
| 3,456,701 | 7/1969 | Cornell | 156/211 X |
| 3,505,725 | 1/1970 | Currt | 156/200 X |
| 3,625,803 | 12/1971 | Masulis et al. | 156/563 |
| 3,704,883 | 12/1972 | Don | 156/556 X |
| 3,723,230 | 3/1973 | Troutner | 156/583 X |
| 3,733,975 | 5/1973 | Terrasi | 156/443 X |
| 3,767,510 | 10/1973 | Gustafson | 156/555 X |

*Primary Examiner*—David A. Simmons
*Attorney, Agent, or Firm*—Woodhams, Blanchard and Flynn

[57] ABSTRACT

An apparatus for manufacturing corrugated paper material, which corrugated paper material includes a plurality of corrugated paper strips and planar intermediate inner and outer layers glued together as a unit. One of the corrugated paper strips from a production line is permitted to travel through an adhesive applicating station while the next following corrugated paper strip is moved to bypass the adhesive applicating station and placed on top of the corrugated paper strip which went through the adhesive applicating station and had an adhesive applied thereto. Thereafter, the two superposed corrugated paper strips move through a compression station to effect a tight engagement between the two strips. Thereafter, other processing steps can be performed to the united strips to enhance further handling thereof.

11 Claims, 10 Drawing Figures

APPARATUS FOR THE MANUFACTURE BY MACHINE OF MULTILAYER CORRUGATED PAPER MATERIAL

FIELD OF THE INVENTION

The invention relates to an apparatus for the manufacture by machine by corrugated paper material, in particular for transportable packing containers, by gluing together one or multilayer corrugated paper strips and planar intermediate and outer layers.

BACKGROUND OF THE INVENTION

During the manufacture of one-layer corrugated paper material with outer layers, the corrugated paper strip is deformed wavelike between corrugated rollers, whereafter a starch adhesive is applied onto the two flat outer layers. This layer unit runs then through a drying zone, during which under the action of heat energy the water content is removed from the applied adhesive. For the manufacture of a two or three-layer strip, the described process stations are followed by the same process stations or a multiple of such process stations cumulatively placed in the production line. As a result, only after a complete finishing and drying of the one-layer strip has occurred can the second layer be manufactured, with which the intermediate layer is placed and glued together and exposed to a drying operation, etc. This process thus requires, for the multilayer corrugated paper strips, the correspondingly multiple length of the production line for a one-layer corrugated paper strip. Several hundred meters for a production line for multilayer corrugated paper material are hereby required. One must add, that due to the thickness of the layer material, which thickness increases because of the successively occurring stacking of the individual corrugated paper strips, the removal of water from the adhesive takes much longer during the drying operation because a portion of the applied heat energy is absorbed from the outer layers. An increase of the temperature in the drying stretch is not possible due to the temperature-sensitive paper material.

The aforementioned difficulties occur in particular if a corrugated paper material is to be manufactured which, as in the known case, is comprised of four or five single corrugated paper strips or of two prefabricated two-layer corrugated paper strips. For the manufacture of such a material in the usual manner of production, an extremely long production line which would far exceed the dimensions of a common production place and a very long process duration would be necessary, whereby one would have to add that due to the necessarily long-time and intensive heat treatment the paper material, if it does not burn, would certainly suffer damage due to the intensive heat treatment with respect to its self-elasticity and mechanical stability.

The basic purpose of the present invention is now to develop an apparatus for the manufacture of multilayer corrugated paper material in such a manner that, independent from the number and structure of the layers (corrugated paper strips) which must be connected, a short process duration and economical process sequence can be achieved compared with conventional methods, and that it is assured that a damaging effect of the process on the quality of the product can certainly be excluded.

This purpose is attained according to the present invention, by providing one of the corrugated paper strips, outer layers and/or intermediate layers, which are to be glued together, with a cold setting, preferably waterproof adhesive, and after placing the corrugated paper strips and/or intermediate or outer layers one on top of the other by running the thus obtained sheet unit through a compression station, in which the layers are pressed against one another with a mechanical pressure which only elastically deforms the corrugations of the corrugated paper strips.

Due to the fact that for connecting the individual corrugated paper strips a cold setting adhesive, a plastic adhesive, a dispersion adhesive or the like is used, all thermal effects do not exist during the connecting process which could, as above discussed, have disadvantageous effects on the paper material. In particular, the connection which takes place between the adhesive and the limit surfaces of the superposed materials is hereby independent from the thickness or from the number of the individual layers of the corrugated paper material. This independency permits, contrary to conventional methods of manufacture, to place two relatively thick, prefabricated corrugated paper strips on top of one another after the application of the adhesive and to connect same with one another by mechanical pressure without having to be concerned that the setting process does not take place at all or takes place only insufficiently, may be because of an insufficient penetration of the poorly heat-conducting material by the heat energy applied from outside. In a special manner, the process of the invention makes it possible that the process sequence is shorter in time and can be carried out by a shorter production line in which for each application of one individual layer a separate drying stretch is required. Due to the independence from thermal influences, the inventive process is particularly suited for very thick corrugated paper materials, as they are used for packing containers for heavy goods or also for living space walls or decorative walls. During the manufacture of such materials it is advantageous, that in the compression station the adhesive wetness can spread unhindered from the inside of the material to the outside, for example by heat energy flowing in from outside, where such adhesive wetness during the compression operation slightly wets the material layers and thus to a certain degree overcomes the mechanical tensions possibly existing in the corrugated paper strips and permits a planar, extensively tensionfree abutment of the limit surfaces of these corrugated paper strips on one another to form an extremely tight, gapless connection. By using waterproof adhesives, a closed waterproof layer is created in the material center, which layer, also in the case of injury to the material outer or inner side, prevents a moving of the wetness to the material layer lying on the other side of the waterproof layer.

According to a further development of the invention, at least two conventionally individually prefabricated two or multilayer corrugated paper strips are placed one on top of the other after applying the adhesive on only one of the directly adjacent outer layers of the corrugated paper strips and are fed together to the compression station. Corrugated paper strips can hereby be used which have two equally thick outer covers and one thinner intermediate cover. A particularly strong center material having a duplicate cover thickness is thereby obtained. By applying the adhesive onto the outer layer of only one of the strips, the process of manufacture is simplified in as far as during the time in which the adhesive is applied on the one strip, the other strip is fed to a superposing station, is turned possibly at 180° and then united with the strip which has the adhesive thereon and which comes on a conveyor belt. These parallel running process steps can be adjusted to one another in such a manner that a continuous manufacturing sequence takes place.

According to a further development of the inventive process, two two or multilayer corrugated paper strips, each of which has on the one side a thin outer layer and on the other side a thick outer layer and after applying the adhesive onto the thin outer layer of one of these corrugated paper strips, are placed one on top of the other with their thin outer layers in engagement and are fed to the compression station. The two thin outer layers become united in a thick strong intermediate layer reinforced by the adhesive layer. A process for the manufacture of such a corrugated paper material can be constructed by providing one of the corrugated paper strips, which comes from an upstream production line which serves the manufacture of the two or multilayer corrugated paper strips or from a storage area, with an adhesive in an adhesive application station, while the second corrugated paper strip arriving from the upstream production line or from the storage area is fed to a superposing station, is turned 180° and is placed onto the first corrugated paper strip which has been transported into the superposing station. A combination of the connecting line which glues together the multilayer strips with a production line of conventional type in which the individual strips are produced, is advantageous because in the production line the two-layer strips, for example, can be manufactured at relatively high running speed, while, as already discussed, in the following connecting line itself extremely thick strips can be united in one single, relatively short process step at a running speed of approximately 20 to 25 m. per minute. The running speed can also be increased to higher speeds, for example 70 m. per minute.

The corrugated paper strips which are to be glued together are hereby advantageously manufactured together in one single production line which is located upstream of the adhesive application station, are portioned and fed separately to the adhesive application station and to the superposing station.

According to a further development of the inventive process, all corrugated paper strips are manufactured together in one single production line and are thereafter fed in portioned sections to at least two parallel connecting lines which have each one adhesive application station, one superposing station and one compression station. This meets the situation that the running speed in the production line is possibly slightly faster than the one in the connecting line. Through this distribution of the portioned corrugated paper strips onto parallel connecting lines, the manufacture flow determined by the higher speed of the production line is not interrupted.

An apparatus for carrying out the above-discussed process is characterized by a connecting line which exists for the reciprocal connection of the corrugated paper strips, comprising an adhesive application station, in which at least one of the corrugated paper strips is provided with a continuous adhesive layer, a superposing station in which the corrugated paper strips which are to be connected are placed one on top of the other and of a compression station, in which the united corrugated paper strips are pressed against one another under mechanical pressure.

The compression station preferably has motor-driven roller pairs which are arranged one behind the other, whereby the distance between the rollers of one roller pair can preferably be adjusted individually. It has been proven to be advantageous in practice, if the rollers are slightly bellied. The contact pressure of these rollers can be adjusted exactly in consideration of the thickness of the material which is to be worked. In order to apply during the entire compression station an uninterrupted pressure onto the sheet unit, in a further development of the invention, the roller pairs are positioned with their axes of rotation skewed to the axis of transport direction for the corrugated paper strips.

According to a further development of the invention, the adhesive application station has a motor-driven roller pair, of which one of the rollers is connected with a container which contains a liquid adhesive. The liquid adhesive flows and spreads equally to all sides on the surface of the respective corrugated paper strip and assures a homogeneous, uninterrupted film of adhesive, which is also capable of evening out possibly existing unevennesses in the outer layer of the strip.

According to a still further development of the invention, a conveyor device is provided for the corrugated paper strips which are to be placed onto the corrugated paper strips which are provided with an adhesive, which conveyor device is connected on one side of the upstream production line before the adhesive application station and on the other side to the superposing station. This conveyor device takes the strips from the upstream production line outlet or from a storage area, for example in a two step succession, and feeds same to the superposing station bypassing the adhesive application station, at which superposing station the unification takes place.

An advantageous embodiment of the apparatus for carrying out the process exists in an upstream production line being connected before the connecting line, in which upstream production line the corrugated paper strips are manufactured which are subsequently connected, and a processing line being connected after the connecting line, in which processing line the connected corrugated paper strips are provided with bending folds or bending grooves and/or are portioned or cut. An outstanding advantage of the invention compared with conventional production lines is that it is possible without an excessive extension of the production line for corrugated paper material, which extension would be problematic in economical and technical respects, to combine a conventional production line, a connecting line and a finish processing line. It is possible to insert in the processing line various fixtures to manufacture bending folds, bending grooves or the like. Thus it is possible to provide in an advantageous manner in this processing line a milling device having a preferably V-shaped profile miller, with which profile miller bending or folding grooves can be produced in the finish glued corrugated paper strips. The provision of milling grooves has proven to be advantageous and necessary in particular in the case of the corrugated paper material which is often extremely thick and produced with the inventive process, because only such grooves permit a convenient, manual bending of particularly sharp folding edges in a packing. The profile millers can be precisely adjusted so that the milling groove does not hurt the waterproof adhesive film inside of the material.

BRIEF DESCRIPTION OF THE DRAWINGS

The inventive apparatus will be discussed hereinafter in connection with exemplary embodiments illustrated in the drawings, in which.

DETAILED DESCRIPTION

Figure 1:
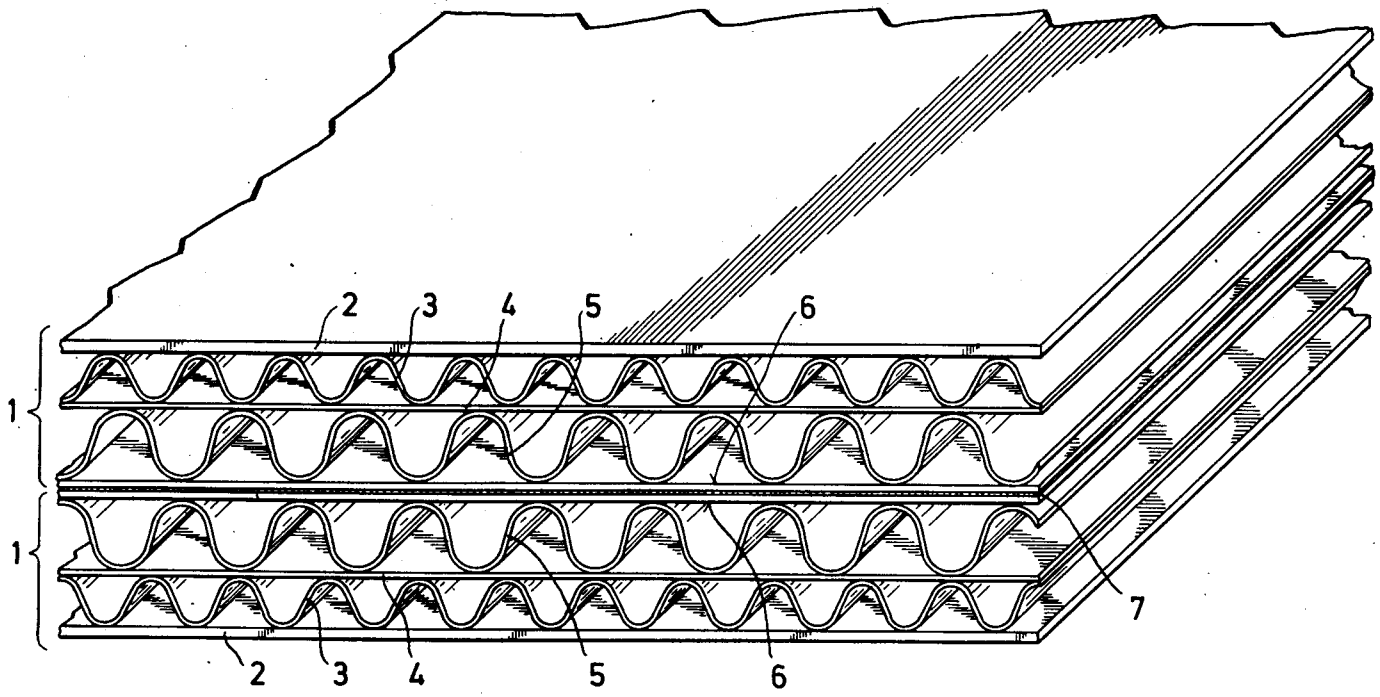
FIG. 1 is a perspective illustration of the corrugated paper material which is manufactured with the inventive apparatus.

FIG. 1 is a cross-sectional view of a sheet of corrugated paper material. The sheet is composed of two two-layer corrugated paper strips 1 which are glued together. The corrugated paper strips 1 are each identically constructed and are placed one on top of the other in a mirrorimagelike fashion. Each corrugated paper strip 1 consists of a planar thick outer layer 2, a first corrugated layer 3, a planar intermediate layer 4, a second corrugated layer 5 and of a thin, planar outer layer 6. Reference numeral 7 identifies a homogeneous, noninterrupted, waterproof adhesive layer, which at a normal room temperature sets cold, for example a dispersion glue, a plastic glue or generally a cold glue. This adhesive layer 7 connects the two thin outer layers 6 of each of the strips 1 and forms together a thick, stable intermediate layer 6/7, which lends the corrugated paper material a great natural stability and which prevents moisture from penetrating from one material half into the other material half or at least makes same difficult. Of course, it is also possible to produce with the hereinafter-described process many different constructions, for example five or six-layered corrugated paper material.

Figure 2:
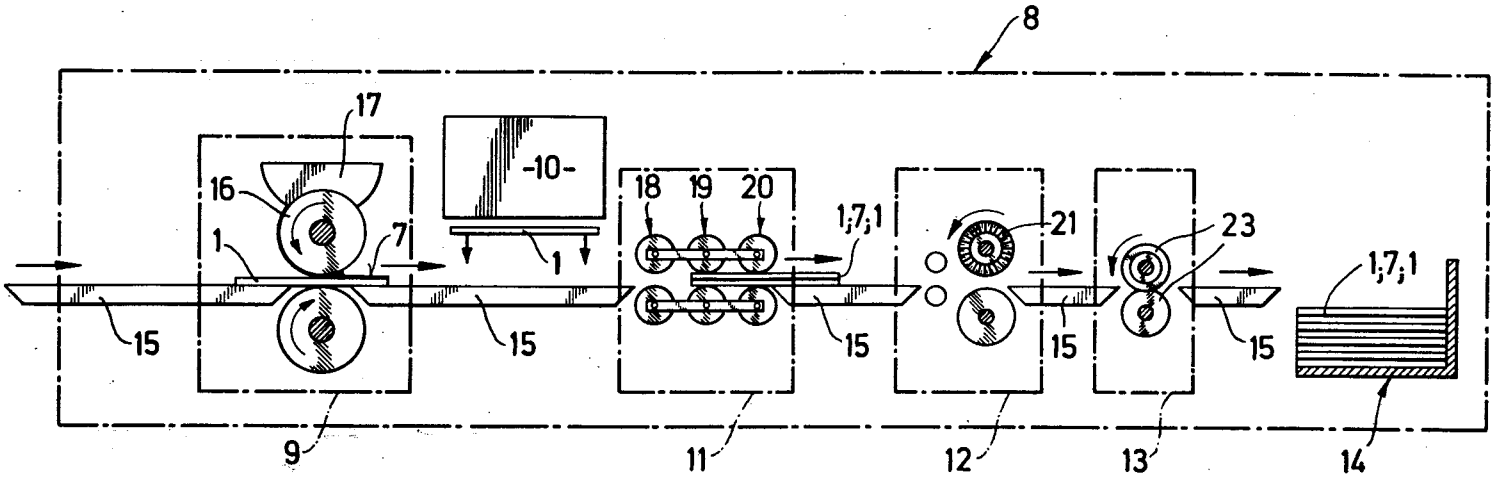
FIG. 2 is a schematic illustration of a connecting line, in which the two-layer corrugated paper strips shown in FIG. 1 are glued together.

FIG. 2 illustrates a connecting and processing line 8, in which the corrugated paper strips 1 are glued together according to FIG. 1 and are subsequently additionally processed. In the connecting and processing line 8, reference numeral 9 identifies an adhesive application station, reference numeral 11 identifies a compressing station, reference numeral 12 identifies a folding groove milling device, reference numeral 13 identifies a cutting device having cutting wheels 23 and reference numeral 14 identifies a final storage. The individual stations in the connecting and processing line 8 are connected to one another by transport devices, for example conveyor belts or by simple transport plates 15. The connecting and processing line 8 operates as follows:

The corrugated paper strips 1, which come from a storage place or from a production line which produces the individual corrugated paper strips located upstream of the line 8 are fed to the adhesive application station 9. This station 9 consists of a motor-driven pair of rollers, of which the upper roller 16 is connected in association with a funnel 17 which contains a liquid adhesive and is open toward the roller 16 so that an even application of the adhesive is applied in longitudinal grooves on the periphery of the roller. The strip 1 which is coated with an even adhesive layer 7 is moved into the zone of the superposing station 10 which zone is predetermined by not illustrated stops in which superposing station, in the meantime, a second corrugated paper strip 1 which is rotated at 180° relative to the mentioned strip 1 is already present and waiting, which strip is now placed flush onto the adhesive layer 7. Now the thus produced sheet unit 1/1 is transferred to the compressing station 11, which in the illustrated example consists of three roller pairs 18,19,20, between which a mechanical pressure which only elastically deforms the corrugations of the corrugated layers 3,5 is applied onto the sheet unit 1/1. The strength and time duration of this pressure is sufficient to create a complete setting of the adhesive 7 and a solid adhesive connection between the corrugated paper strips 1. In the case of four roller pairs a running speed of 20 to 25 m. per minute has been proven to be satisfactory.

Figure 10:
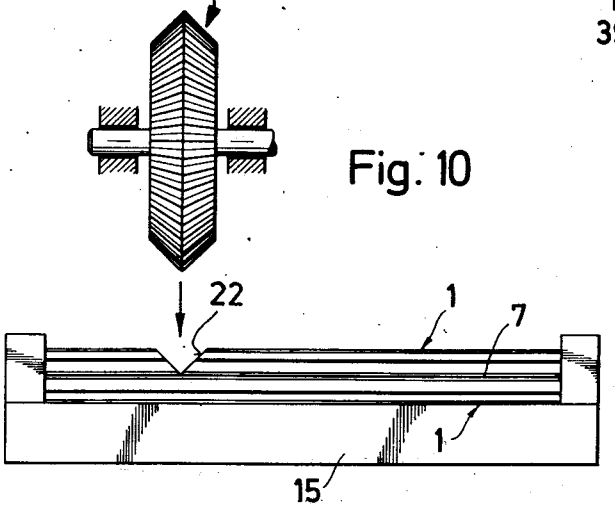
FIG. 10 illustrates a fixture for working the finish glued corrugated paper material.

The finish glued sheet units are now fed to the milling device 12 illustrated in FIG. 10. The milling device 12 has a V-shaped profile miller 21 which can be lowered and longitudinally or transversely moved in the plane of the corrugated paper strips and cuts a V-shaped groove 22 into the corrugated sheet 1/1, which groove substantially simplifies the bending of a particularly narrow fold like a container. Finally in the cutting device 13, the corrugated sheet 1/1 is portioned by means of a miller or knife 23 which cuts in the longitudinal or transverse direction.

Figure 3:
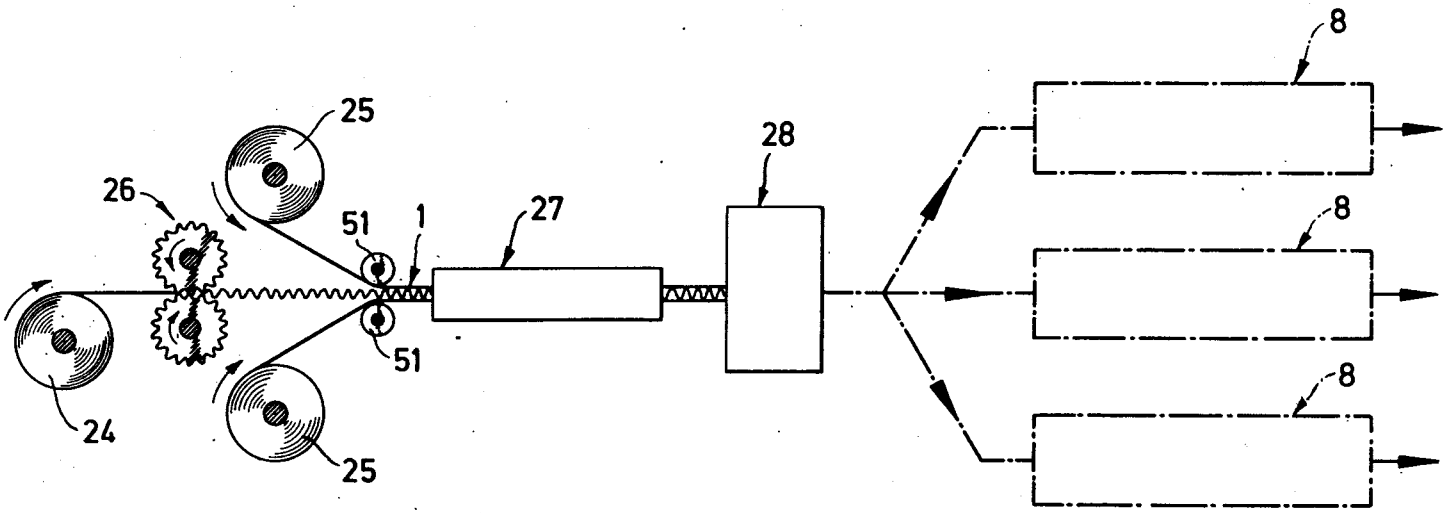
FIG. 3 is a schematic illustration of the connecting line combined with a conventional upstream production line.

In FIG. 3 a conventional production line for the manufacture of a two-layer corrugated paper strip 1 is connected upstream of one or several parallel positioned connecting and processing lines 8. The upstream located production line consists (1) of delivery rolls 24 and 25 of intermediate and outer layer strips, (2) of a corrugated roller pair 26 for producing the corrugations in the strip from the roll 24, (3) of pressure rollers 51, (4) of a heatable drying path 27, in which the strips which have first been provided with an adhesive are connected with one another and (5) of a portioning device 28, with which the endless corrugated paper strip 1 is divided into individual sections. The corrugated paper strip sections 1 which come in relatively quick succession from the upstream production line are passed on either to the connecting and processing line 8, indicated by full lines, or, however, in successive distribution to several parallel connecting and processing lines, where they become treated in the described manner. This division makes it possible in a simple manner to adjust the speed of the upstream production line which runs at a higher running speed to the connecting and processing line which runs at a slightly slower running speed.

Figure 6:
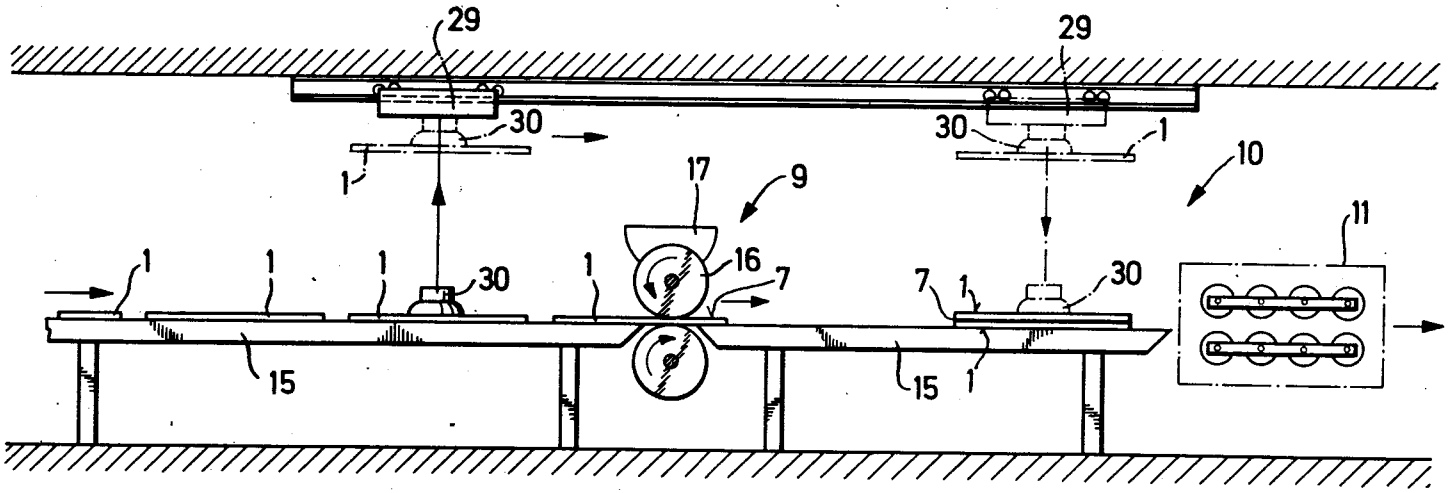
FIG. 6 is a schematic illustration of a conveyor mechanism which connects the upstream production line with the superposing station of the connecting line.

In the exemplary embodiment according to FIG. 6, a conveyor device exists which, on the one hand, is connected to the superposing station 10 (FIG. 2) and, on the other hand, to the end of the aforedescribed upstream production line. The conveyor device consists of a gripping member, which can be driven on a crane 29 mounted on the ceiling of a workshop and is in the form of a suction bell 30 which can be connected to a vacuum chamber and which is lowered onto each second proportioned corrugated paper strip 1 arriving thereat from the upstream production line. The bell 30 is connected to the strip 1 under the action of a created vacuum and thereafter moved over the adhesive application station 9 into the area of the superposing station 10 and is placed flush onto the associated strip 1 which is provided in the meantime with an adhesive at the adhesive application station.

Figure 7:
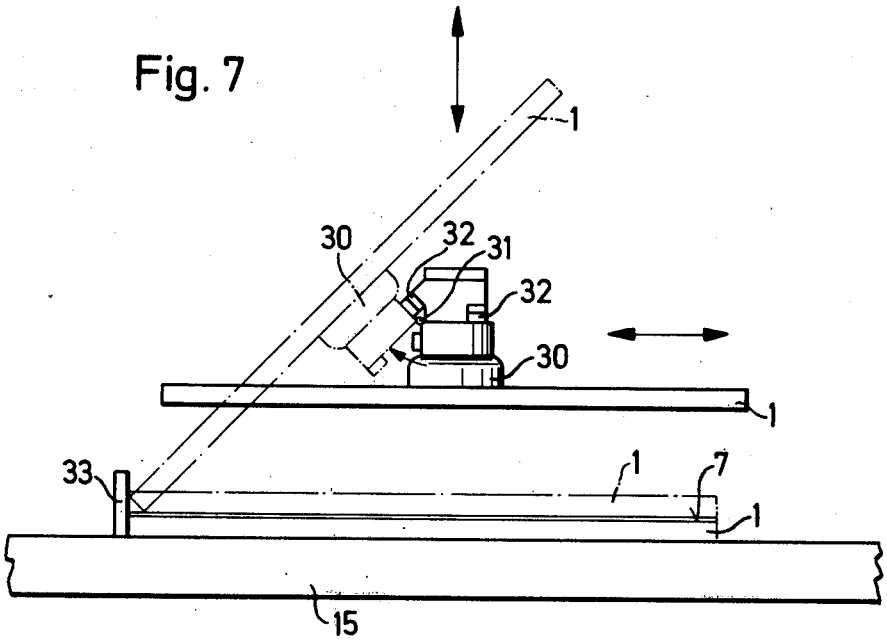
FIG. 7 shows a detail of a conveyor mechanism according to FIG. 6.

In order to be able in the manufacturing process of corrugated paper material constructed according to FIG. 1 to rotate the strip 1 180°, which is to be superposed on another strip 1, the suction bell 30, or the gripping member which is constructed in a different manner, is pivotally supported by a reversing joint 31 (FIG. 7) for movement through more than 90°, whereby the suction bell 30 is held in each pivoted position by an electromagnet 32 which can be alternately switched on or off. After swinging the strip 1 into the desired position, the suction bell 30 is pressurized to release the strip 1 and is moved in the direction of the arrows away from the strip 1, after which the strip 1 which is supported on a stop 33 falls flush onto the strip 1 which has the adhesive thereon and which is also ready and waiting at the stop.

Figure 8:
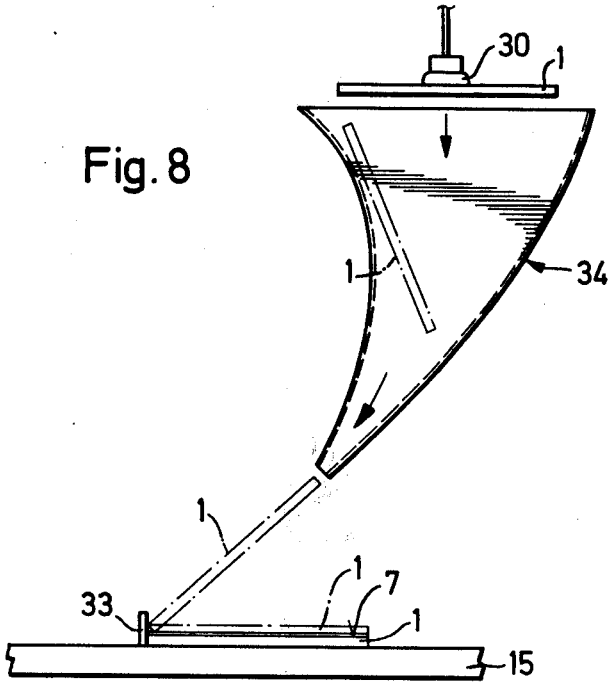
FIG. 8 illustrates a different embodiment of a part of the conveyor mechanism.

According to FIG. 8, the strip 1 which is moved into the area of the superposing station 10 is dropped into a guide drop funnel 34, in which the strip is rotated for almost 180° along the arced reversing funnel paths and finally falls onto the other strip 1 which is ready and waiting at the stop 33.

Figure 9:
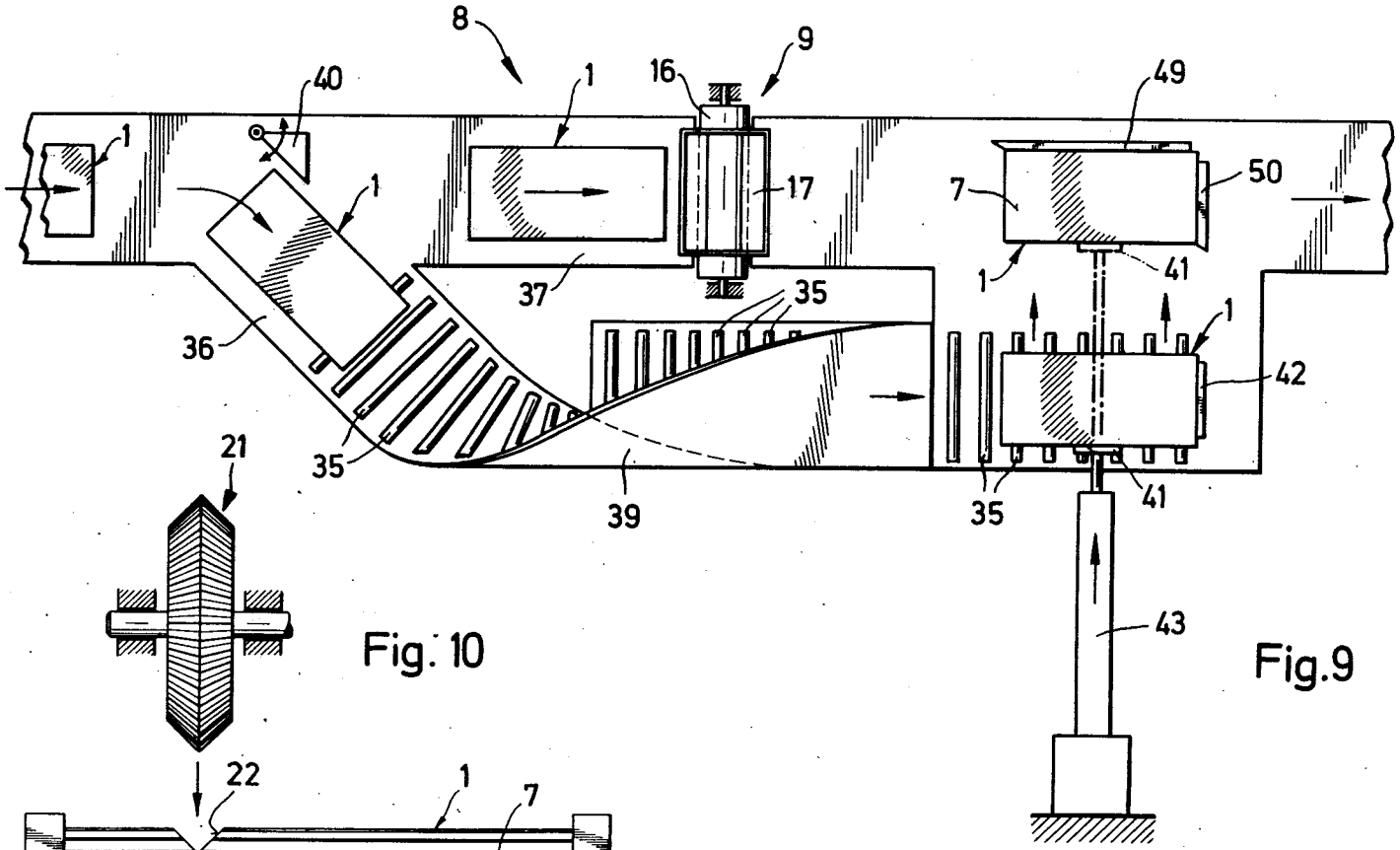
FIG. 9 illustrates a modified embodiment of a conveyor mechanism.

FIG. 9 illustrates a further embodiment of a conveyor device for the strips of corrugated paper 1 which must be applied. It consists of a conveyor path 36 which has motor-driven conveyor rollers 35. The conveyor path 36 branches off in the area of the end of the upstream production line from the main conveyor path 37 which leads rectilinearly to the beginning of the connecting line 8. A curvilinear guide 39 is provided for twisting the strips 1 at 180°. A switch 40 is provided at the splitting point, which switch can be adjusted into two positions to cause an oncoming strip to enter either the conveyor path 36 or the conveyor path 37. A shift unit is identified by reference numeral 41. The shaft unit 41 moves the 180° reoriented strip 1 which lies ready at the position of the superposing station against a stop 42 by the force of a schemetically indicated pressure cylinder 43 in the direction of the strip 1 on the conveyor path 37 and which has the adhesive thereon and subsequently into engagement therewith. The engagement point at which the two corrugated paper strips 1 become placed one on top of the other and glued together is exactly marked by stops 49 and 50, whereby the stop 50 can be removed after the engaging operation, for example, can be lowered and thus frees the conveyor path 37 from obstruction.

Figure 4:
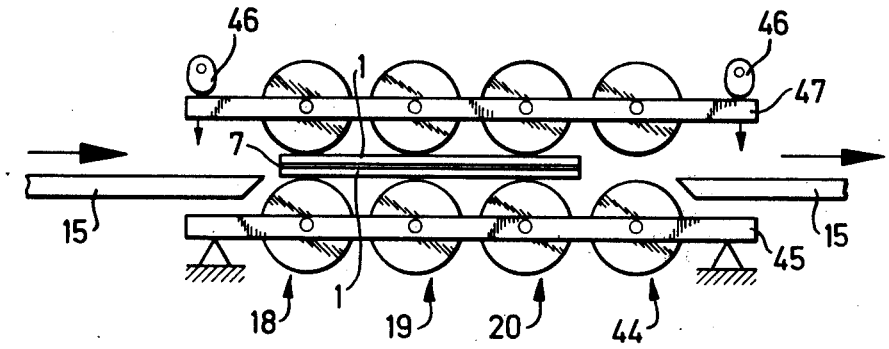
FIG. 4 is a schematic illustration of the compressing station of the connecting line according to FIG. 1.

FIG. 4 illustrates the compressing station 11 (FIG. 2) which has already been indicated in connection with the preceding figures and which has four roller pairs 18, 19, 20 and 44. The lower rollers in FIG. 4 of the rollers pairs are stationarily supported by a common carriage 45, while the upper rollers are supported on a carriage 47 which can be vertically adjusted, for example, by means of cam drives 46, relative to the lower rollers 18,19,20,44.

Figure 5:
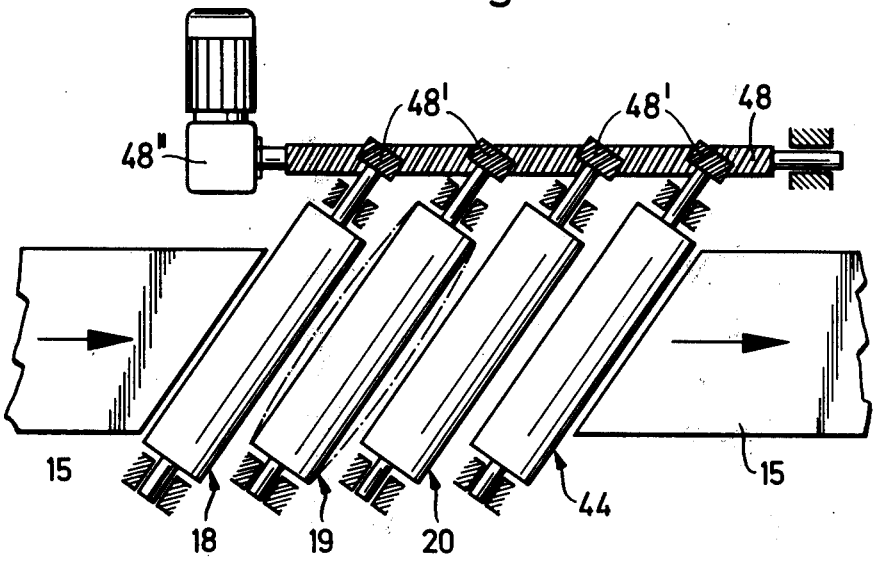
FIG. 5 is a different embodiment of the compressing station.

According to FIG. 5, the rollers of the roller pairs 18,19,20,44 are skewed with respect to the conveyor path of the connecting line 8, which causes the corrugated paper strips which are to be further treated to be in an interrupted engagement with the overlapping roller pairs. The rollers are commonly driven by a drive spindle 48 from a drive 48'' through gears 48'. As illustrated in the dash-dot-lined example, it is shown that the rollers may have a bellied contour.

The sequences of movement of the described upstream production line and the connecting and processing line and the conveyor devices can be commonly controlled, for example, by a tape program control device, so that a fully automatic operation is possible. Also it is possible, however, to carry out individual method steps manually, as for example the removal of the corrugated paper strips from the storage stack and placing same onto the strips which have the adhesive thereon.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for the manufacture of laminated corrugated strips, each corrugated strip including a pair of planar paper outer layers and corrugated layer means between said outer paper layers, comprising:

a cold setting, waterproof adhesive;

adhesive applying means for applying a layer of said cold setting, waterproof adhesive on one of said pair of planar paper outer layers;

superposing means immediately adjacent an output end of said adhesive applying means for superposing a corrugated strip onto said layer of adhesive;

compressing means immediately adjacent an output end of said superposing station for applying a pressure to said superposed corrugated strips and said adhesive layer to elastically deform the corrugations in said corrugated layer means whereby a waterproof barrier is created between said superposed corrugated strips, said compressing means including a plurality of motor-driven roller pairs arranged one behind the other and including means for adjusting the spacing between said roller pairs, the rollers of said roller pairs being skewed with respect to the path of movement of said laminated corrugated strips through said compressing means; and conveying means for conveying said corrugated strips to said adhesive applying means, said superposing means and said compressing means.

2. An apparatus according to claim 1, including means for applying a folding groove to said superposed and adhesively secured corrugated strips.

3. An apparatus according to caim 1, wherein said conveying means includes a conveyor surface, means defining a single assembly source for said corrugated strips and proportioning means for dividing the flow of said corrugated strips on said conveyor surface between said adhesive applying means and said superposing means.

4. An apparatus according to claim 1, wherein said conveying means includes a plurality of laminate producing lines each comprising adhesive applying a cold setting, waterproof adhesive, means for applying said cold setting, waterproof adhesive, superposing means, compressing means and second proportioning means for dividing the flow of corrugated strips between said laminate producing lines.

5. An apparatus according to claim 1, wherein said rollers of each roller pair have a contoured outer surface wherein each roller is larger is diameter at the center thereof than at the ends.

6. An apparatus according to claim 1, wherein said adhesive applying means includes a motor-driven roller pair and a container for housing said adhesive operatively connected to one roller of said roller pair to dispense adhesive thereon, said one roller engaging said one of said pair of planar paper outer layers.

7. An apparatus according to claim 1, wherein said conveying means includes a conveyor surface, means defining a single assembly source for said corrugated strips and proportioning means for dividing the flow of said corrugated strips on said conveyor surface between said adhesive applying means and said superposing means; and wherein said conveyor surface includes a segment connected to said conveyor surface between said single source and said adhesive applying means and extends to said superposing means; and wherein said proportioning means divides the flow of corrugated strips between said conveyor surface extending to said adhesive applying means and said segment.

8. An apparatus according to claim 1, wherein said superposing means includes a gripping device for gripping alternate ones of said corrugated strips on said conveyor means prior to entry into said adhesive applying means and transporting said alternate one of said corrugated strips to a location on said conveyor means between said adhesive applying means and said compressing means and thence depositing same on said adhesive layer.

9. An apparatus according to claim 8, wherein sad gripping device includes means for turning said alternate ones of said corrugated strips more than 90°.

10. An apparatus according to claim 8, wherein said gripping device includes means for turning said alternate ones of said corrugated strips 180° and includes means defining a guide drop funnel which is adapted to receive and guide said turned corrugated strips in the turned position down onto said adhesive layer.

11. An apparatus according to claim 1, wherein said conveying means includes a conveyor surface, means defining a single assembly source for said corrugated strips and proportioning means for dividing the flow of said corrugated strips on said conveyor surface between said adhesive applying means and said superposing means; and wherein said conveyor means includes a milling device located immediately adjacent an output end of said compressing means and having a convex profiled milling tool for milling a groove into said laminated corrugated strips.

* * * * *